US006475964B1

(12) United States Patent
Neudoerfl et al.

(10) Patent No.: US 6,475,964 B1
(45) **Date of Patent: *Nov. 5, 2002**

(54) MOTOR OIL WITH HIGH DISPERSIVITY AND GOOD WEAR PROTECTION CHARACTERISTICS

(75) Inventors: Peter Neudoerfl; Horst Pennewiss, both of Darmstadt; Gerhard Renner, Riedstadt, all of (DE)

(73) Assignee: Roehm GmbH & Co. KG, Darmstadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/510,272

(22) Filed: Aug. 2, 1995

(30) Foreign Application Priority Data

Aug. 3, 1994 (DE) ..... 44 27 473

(51) Int. Cl.[7] ..... C10M 161/00
(52) U.S. Cl. ..... 508/469; 508/472; 252/79
(58) Field of Search ..... 508/472, 469, 508/471; 44/393, 394

(56) References Cited

U.S. PATENT DOCUMENTS

| | | | | |
|---|---|---|---|---|
| 3,001,942 | A | | 9/1961 | Mulvany et al. |
| 3,088,931 | A | | 5/1963 | Scanley et al. |
| 3,089,832 | A | | 5/1963 | Black et al. |
| 3,198,739 | A | * | 8/1965 | Richards et al. |
| 3,377,285 | A | * | 4/1968 | Randles |
| 3,879,304 | A | | 4/1975 | Waldbillig |
| 4,146,489 | A | * | 3/1979 | Stambaugh et al. |
| 5,188,770 | A | * | 2/1993 | Pennewiss |

FOREIGN PATENT DOCUMENTS

| | | | |
|---|---|---|---|
| DE | 2556080 | * | 6/1976 |
| DE | 2634033 | * | 2/1977 |
| DE | 2832406 | * | 2/1979 |
| EP | 0418610 | * | 3/1991 |
| FR | 1 173 356 | | 2/1959 |
| FR | 2069681 | * | 8/1971 |
| GB | 1 333 733 | | 10/1993 |

OTHER PUBLICATIONS

Kirk–Othmer Encyclopedia of Chemical Technology, 3rd ED., vol. 14, John Wiley & Sons, N.Y., pp. 492–493, 1981.*
Erdöl und Kohle–Erdgas–Petrochemie vereinigt mit Brennstoff–Chemie, Wissenschaft & Technik, Oct. 10, 1989, pp. 402–404.*

* cited by examiner

*Primary Examiner*—Margaret Medley
(74) *Attorney, Agent, or Firm*—Oblon, Spivak, McClelland, Maier & Neustadt, P.C.

(57) ABSTRACT

Motor oils and transmission oils of the usual commercial SAE single- and multiple viscosity classes, which oils contain polymeric additives and which have high dispersivity and good wear protection characteristics, said oils containing the following additives:

(i) at least one heavy-duty (HD) additive, which contains phosphorus compounds; and (ii) as dispersive polymeric components PC, cooligomers copolymers, or combinations thereof comprised of:
(a) units of $C_{6-24}$ alkyl (meth)acrylates,
(b) units of at least one functionalized alkyl (meth) acrylate,
(c) units of one or more $C_{1-5}$-alkyl (meth)acrylate monomers, and
(d) units of 1-alkenes, with the following provisions:

(1) the units of formulas I and II together comprise 100 wt. %, (2) the content of polymer components) PC in the additive-containing mineral oils is in the range 0.5–50 wt. %, and (3) the content of phosphorus in the additive-containing mineral oils is less than or equal to 0.08 wt. %.

5 Claims, No Drawings

MOTOR OIL WITH HIGH DISPERSIVITY AND GOOD WEAR PROTECTION CHARACTERISTICS

BACKGROUND OF THE INVENTION

Field of the Invention

The invention relates to motor oils having high dispersivity (dispersing power) and good wear protection characteristics.

DISCUSSION OF THE BACKGROUND

As an internal combustion engine is operated, there is a tendency for the concentration of oil-insoluble combustion products to build up in motor oil. The combination products include resin- and asphalt-containing products, and other impurities (collectively referred to as "sludge") (see 1990, "Ullmann's Encyclopedia of Industrial Chemistry", 5th Ed., Vol. A15, pub. VCH, pp. 448–450).

It has been known for some time that dispersivity and detergency can be promoted with the use of oil-soluble polymer additives containing units of functional monomers incorporated by, e.g., ordinary co-polymerization or graft polymerization (see 1967, Rauch-Puntigam, H. and Voelker, Th., "Acryl- und Methacrylvergindungen", pub. Springer-Verlag, pp. 315–316; Ger. OSs 28 32 406, 25 56 080, 26 34 033; U.S. Pat. Nos. 3,088,931, 3,089,832, 3,879,304, 4,146, 489, etc.). Also, nitrogen-containing polymer additives have been found to have good dispersive effects; however, their wear protection and detergent characteristics are unsatisfactory.

These so-called "ashless dispersants" are therefore generally used in combination with additional, metal-salt-containing additives, supplied in "packages" (see Bartz, W. J., "Additive fuer Schmierstoffe", pub. Curt R. Vincentz Verlag, pp. 65–67). Important components used are zinc dialkyldithio-phosphates (ZnDDP), which have anti-wear and antioxidant properties as well as metal containing detergents. Such metal containing additives decompose with formation of ash, as would be expected. The ash along with other residues from the motor oils becomes increasingly detrimental to the engine as the service time increases.

In practice obvious attempts have been made to employ both types of additives simultaneously—the polymer additives and the "packaged" formulations comprising the metal-salt-containing additives. Accordingly, compatibility of the two types of additives is an important issue. Strongly polar substituents, particularly basic substituents, on the radial sealing ring additives, m ay also lead to problems with radial sealing ring materials.

There has been a search for polymer additives with substituents which provide less polarity. U.S. Pat. No. 3,198, 739 discloses copolymers of long-chain (meth)acrylic acid esters and omega-hydroxyalkyl esters of (meth)acrylic acid with alpha-olefins or vinyl- or allyl esters. The outstanding detergency of such copolymers has been described. In U.S. Pat. No. 3,001,942, it is stated that the object of the invention is to devise lubricating oil additives having improved detergency, wherewith metal-containing ash does not occur in the sediment from said additives. The described additives are comprised of copolymers of long-chain (meth)acrylic acid alkyl esters and monoesters of polyoxy-1,2-alkylene glycols with lower aliphatic α,βB-unsaturated monocarboxylic acids.

In Fr. Pat. 1,173,356, additive preparations are described which are comprised of units of ethylenically unsaturated aliphatic monomers having 4–30 aliphatic C atoms, esters of α,β-unsaturated mono- or dicarboxylic acids with polyalkylene glycols having 2–7 C atoms, and alkyl ethers thereof, and which contain polar groups having hydroxy- and/or amino substituents. Copolymers of long-chain (meth)acrylic acid esters and (meth)acrylic acid monoesters of polybasic alcohols are employed, e.g., in U.S. Pat. No. 3,377,285; and β-hydroxyethyl ester forms are employed in Fr. Pat. 2,069,681 and Brit. Pat. 1,333,733.

In Eur. Pat. 0,418,610 (U.S. Pat. No. 5,188,770), agents for improving the viscosity index (VI) are described, which agents have dispersant action and contain polyalkyl (meth) acrylate (PAMA) polymers based on long-chain alkyl (meth) acrylates and functionalized (meth)acrylic acid alkyl esters from the group of the hydroxyalkyl esters and the multiply alkoxylated alkyl esters, in combination with olefin copolymers and/or HSD copolymers and/or hydrogenated polyisoprene or polybutadiene.

A need has continued to exist for a way of devising additive-containing motor oils having high dispersivity and good wear protection characteristics, in which the content of nitrogen-containing dispersants and ash-forming phosphorus-containing and metal salt-containing additives in said motor oils is substantially less than the customarily used and recommended concentrations.

SUMMARY OF THE INVENTION

Accordingly, one object of the present invention is to provide additive-containing mineral oils.

The invention relates to polymeric-additive-containing motor oils and transmission oils of the commercial SAE single-and multiple viscosity classes, which oils have high dispersivity and good wear protection characteristics and which comprise the following additives:

(i) heavy-duty additives (HD additives) of types which are per se known, having a certain content of zinc compounds, particularly zinc dialkyl phosphorodithioates (ZnDDP), as antioxidants and wear protection agents (see 1989 *Erdaas und Kohle*, 42(10):402–404; and Kirk-othmer, 1981, "Encyclopedia of Chemical Technology", 3rd Ed., pub. J. Wiley, Vol. 14, pp. 492–493); and (ii) as dispersive polymeric components PC, cooligomers and/or copolymers comprised of (a) units of alkyl (meth)acrylates of formula I

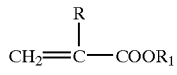

(I)

where R represents hydrogen or methyl, and $R_1$ represents an alkyl group with 4–34 C atoms, preferably 6–24 C atoms, more preferably 8–22 C atoms, said units of formula I being present in the amount of 60–99.5 parts by weight (based on the total weight of monomers in PC), and (b) units of at least one functionalized alkyl (meth) acrylate of formula II

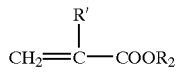

(II)

where R' represents hydrogen or methyl, and $R_2$ represents an alkyl group having 2–6 C atoms and substituted with at least one OH group, or $R_2$ represents a multiply alkoxylated group

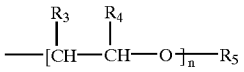

where $R_3$ and $R_4$ represent hydrogen or methyl, $R_5$ represents an alkyl or alkaryl group having 1–40, preferably 1–18 C atoms, and n represents an integer in the range 1 to 60, preferably 1 to 40, wherewith if n ≧2 then $R_5$ may represent hydrogen, said units of formula II being present in the amount of 0.5–40 parts by weight (based on the total weight of monomers I and II), further, (c) units of one or more monomers of formula III

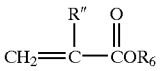

(III)

where R" represents hydrogen or methyl, and $R_6$ represents an alkyl group with 1–5 C atoms, said units of formula III being present in the amount of 0–20, preferably 0.5–15, particularly preferably 1–12 parts by weight (based on the total weight of monomers I and II), and (d) units of 1-alkenes of formula IV $$CH_2{=}CHR_7 \quad \text{(IV)}$$

where $R_7$ represents an alkyl group having 4–40, preferably 4–24 C atoms, said units of formula IV being present in the amount of 0–50 parts by weight (based on the total weight of monomers I and II); with the following provisions:

(1) the units of formulas I and II together comprise 100 wt. %, (2) the content of polymer components PC in the additive-containing mineral oils is in the range 0.5–50 wt. %, and (3) the content of phosphorus, particularly in the form of zinc dialkyl phosphorodithioate(s) (ZnDDP), in the additive containing mineral oils is less than or equal to 0.1 wt. %, preferably less than or equal to 0.08 wt. %.

DETAILED DESCRIPTION OF THE PREFERRED EMBODIMENTS

The molecular weight of the cooligomers CM according to the invention is in the range 1,000–25,000 Dalton, preferably 1,500–15,000 Dalton; and the molecular weight of the copolymers CP according to the invention is in the range 30,000–500,000, preferably 30,000–150,000 Dalton (determined by gel permeation chromatography—see Mark, H. F., et al., 1987, "Encyclopedia of Polymer Science and Technology", Vol. 10, pub. J. Wiley, 1–19).

Of particular interest are cooligomers CM and copolymers CP wherein the monomers of formula I are comprised of units of (meth)acrylic acid esters having 4–34, preferably 6–24 C atoms, more preferably 8–22 C atoms in the alkyl group; or combinations thereof. Suitable (meth)acrylate esters include butyl acrylate, 2-ethylhexyl acrylate, cyclohexyl acrylate, isodecyl acrylate, tridecyl acrylate, tetradecyl acrylate, pentadecyl acrylate, dodecyl-pentadecyl acrylate, hexadecyl acrylate, heptadecyl acrylate, octadecyl acrylate, cetyl-stearyl acrylate, oleyl acrylate, nonadecyl acrylate, eicosyl acrylate, cetyl-eicosyl acrylate, stearyl-eicosyl acrylate, docosyl acrylate, eicosyl-tetratriacontyl acrylate; and the corresponding methacrylates. Of particular importance are alkyl methacrylates having ≧10 C atoms in the alkyl group, and having a high proportion of iso isomer; e.g., $C_{12}$–$C_{15}$-alkyl esters of methacrylic acid having c. 20–90% of iso isomer, and isodecyl methacrylate. A high degree of branching favors good low-temperature behavior, including the pour point; good viscosity-versus-temperature characteristics are also favored by a certain distribution in the number of C atoms.

Examples of compounds of formula IV include 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene, 1-pentacosene, 1-hexacosene, 1-heptacosene, 1-octacosene, 1-nonacosene, 1-triacontene, 1-hentriacontene, 1-dotriacontene, and the like. Also suitable are branched-chain alkenes, such as, e.g., vinylcyclohexane, 3,3-dimethyl-1-butene, 3-methyl-1-butene, diisobutylene-4-methyl-1-pentene, and the like. Also suitable are 1-alkenes having 10–32 C atoms, found in the polymerization of ethylene, propylene, or mixtures of ethylene and propylene, where the feedstock is obtained ultimately from hydrocracking processes.

In a particularly preferred general type of embodiment the component (A) of the cooligomers CM represents 1-decene, dodecene, or tetradecene. Particularly preferred for the best low-temperature behavior (pour point) is decene.

The feature set forth in provision (c), supra, whereby the content of phosphorus, particularly in the form of zinc dialkyl phosphorodithioates, is kept less than or equal to 0.08 wt. % (based on the overall weight of the additive-containing motor oil), is of great importance for several reasons including the ecological standpoint. With additives practice according to the state of the art, it is deemed necessary to employ phosphorus amounts of 0.1–1.4 wt. %. The reduction of phosphorus content according to the invention is important because of, e.g., the sensitivity of catalysts to phosphorus compounds in the exhaust gas. In addition, the reduction of the heavy metal content of the additives is itself ecologically favorable. According to the invention, the phosphorus content can be reduced to a range of 0.04–0.08 wt. %, particularly the content of zinc dialkyl phosphorodithioates (ZnDDP). Without having to elucidate the effective mechanisms, one may hypothesize that the dispersive polymer component PC does not interfere with the effectiveness of the zinc compounds in the motor oils. However, it has been found, surprisingly, that the polymer component PC itself has wear-protection effects. In practical tests (of cam wear), the functionalized alkyl (meth)acrylates provide lower wear than comparable dispersive polymer formulations according to the state of the art employing (as is common practice) nitrogen-containing monomers such as, e.g., N-vinylpyrrolidone.

The production methods for the polymer components PC in the form of the cooligomers and/or copolymers which may be used according to the invention are per se known. Cooligomers of the type described are mentioned in Ger. OSs 40 25 493 and 40 25 494. Further, the inventive polymer component PC may be present in combination with olefin copolymers (OCP) in the form of concentrated polymer emulsions, as described in Ger. OS 39 30 142 and U.S. Pat. No. 5,188,770. As known from the state of the art, the cooligomers of the type claimed can be produced under certain conditions by radical polymerization, e.g. thermal polymerization, with addition of a suitable initiator or redox system. The polymerization may be carried out with a suitable solvent, or without a solvent. Any of the solvents commonly used as polymerization -media may be used, or mineral oils, hydrocracked (HC) oils, poly-α-olefins (PAO), esters, or already-produced oligomers. In the process, one may first charge, e.g., the 1-alkene according to formula IV to a suitable reaction vessel wherein the charge is brought to a suitable reaction temperature. The range of advantageous temperatures is generally 80–200° C., particularly 160±20° C. The components of formula I (or formulas I and II) are added to the vessel in the same temperature range, preferably in a feed extending over a certain time interval, e.g. 0.25–10 hr, e.g. 5.5 hr, in the prescribed amounts of such components. Advantageously the mixture is allowed to polymerize for an additional period with the aim of completing the polymerization in a batch mode; such period may be generally a few to several hours, e.g. 6 hr. It has been found to be advantageous to add initiator during the entire reaction period, e.g. portionwise at intervals of 30 min or in a continuous feed. Useful initiators include radical initiators which are per se known (see Kirk-Othmer, 1981, *loc.cit.*, pub. Wiley Interscience, Vol. 13, pp. 355–373; and Rauch-Puntigam, *loc.cit.*). The total amount of initiator is generally 0.1–10 wt. %, preferably 0.1–5 wt. % (based on the total weight of the monomers). Advantageously, initiators are selected which have appropriate decomposition characteristics for the polymerization modalities. As a guideline, a half-life of the initiator in benzene, at the reaction temperature, of 0.25 hr is preferred. Examples of suitable initiators include peroxides such as di-tert-butyl peroxide. The amount of initiator used per portion in a portionwise addition (see above) can range from 0.001–0.005 mol. From experience accumulated to date, the conversion of the monomers may be on the order of, e.g., 98%, so that in many applications one may be able to dispense with means of removing the monomers, or indeed other refining of the product. If particular requirements as to, e.g., flash point, must be met, the residual monomers may have to be removed.

Application of the Polymer Component PC

The mineral oils serving as the base of the formulation may be the usual paraffin-based or naphthene-based oils, or special synthetic oils, with viscosity behavior corresponding to the customary commercially available SAE single- and multi-viscosity classes. A few examples which may be mentioned are mineral oils NS 100 to NS 600 (BP Enerpar 11), hydrocracked (HC) oils, poly-α-olefins (PAO), ester oils, and, e.g., dioctyl adipates, or polyol esters (see "Ullmanns Enzyklopaedie der techn. Chemie", 4th Ed., Vol 10, pub. VCH, pp. 641–714).

Advantageous Effects

The present additive-containing motor oils fulfill the objectives of the invention quite well. These properties include their outstanding compatibility with elastomers, e.g. gasket and sealing materials such as Viton®; further, their low wear characteristics, which enable an appreciable reduction in the amount of the customary wear-protection additives employed, particularly zinc dialkyl phosphorodithioloates (ZnDDP). At the same time, the risk of deterioration of the performance of the catalyst is reduced, in applications in internal combustion engines, which contributes to reduction of possible adverse ecological effects.

Having generally described this invention, a further understanding can be obtained by reference to certain specific examples which are provided herein for purposes of illustration only and are not intended to be limiting unless otherwise specified.

A. Production of the Polymer Component PC in Combination with an Olefin Copolymer (OCP), as a Concentrated Polymer Emulsion:

(a) Production of the additive A-1:

The following mixture was charged to a 2-L four-necked flask having a stirrer, thermometer, reflux condenser, and dosing line:

360.0 g mineral oil (eta at 100° C. =5.4 $mm^2$/sec), 42.0 g ethylene-propylene copolymer (50 wt. % ethylene; shear stability index SSI for 1% in mineral oil having eta at 100° C.=5.4 $mm^2$/sec=24), 5.5 g methacrylic acid ester of an ethoxylated iso-tridecyl alcohol having a mean degree of ethoxylation=20, 2.5 g methyl methacrylate, 36.7 g methacrylic acid ester of a $C_{12}$–$C_{15}$ alcohol mixture, 0.05 g terpenes, 0.61 g tert-butyl peroctoate.

After the components were dissolved, the following mixture was added at a constant rate over a period of 3.5 hr, at 90° C.:

92.7 g methacrylic acid ester of an ethoxylated iso-tridecyl alcohol having a mean degree of ethoxylation=20, 42.2 g methyl methacrylate, 618.6 g methacrylic acid ester of a $C_{12}$–$C_{15}$ alcohol mixture, 0.75 g terpenes, 3.39 g tert-butyl peroctoate.

Two hr following the end of the feeding, an additional 1.6 g tert-butyl peroctoate was added. The total polymerization time was 8 hr. A slightly cloudy, viscous solution was obtained.

This solution was charged to a 4-L three-necked flask having a stirrer, a thermometer, and a reflux condenser, and was brought to 100° C. Then the following were added:

384.5 g ethylene-propylene copolymer (50 wt. % ethylene; shear-stability index SSI (1% in mineral oil having eta at 100° C.=5.4 $mm^2$/sec)=24), and 1913.3 g mineral oil (eta at 100° C.=5.4 $mm^2$/sec).

After dissolution, the mixture was held at 100° C. for 8 hr. A cloudy, viscous emulsion was obtained.

Polymer content: 37.5 wt. %.

Viscosity: (37.5 wt. % material, 100° C.): c. 2800 $mm^2$/sec;

Viscosity: (8.1 wt. % in mineral oil at 100° C., with eta of the mineral oil at 100° C.=5.4 $mm^2$/sec)=14.2 $mm^2$/sec.

SSI (shear-stability index according to DIN 51 382, measure of loss of thickening effect (%) in a prescribed shear-stability test) (8.1 wt. % in mineral oil, where eta of the mineral oil at 100° C.=5.4 $mm^2$/sec): 24.

B. Test Methods:

B-1. Wear test:

To study use of a polymer component PC according to the invention for reducing the phosphorus content (as ZnDDP), a "basic additives package", was prepared (see Table 1 for composition) which, in combination with a non-dispersive viscosity-index improver (VI improver), was intended to produce a performance equivalent to API SG. Sulfate ash and TBN were determined, and gave values which are typical of this performance class. The "basic additives package" was then used to prepare a so-called Core Package wherein (a) the content of ash-free dispersant was reduced to the amount which according to experience is compensated for by the addition of the dispersive polymers according to the state of the art, namely 1.5 wt. %, and (b) the ZnDDP was completely omitted. To such a "Core Package" there were added the dispersive polymer component PC and stepwise increasing amounts of ZnDDP. In the testing of the ash-free dispersant, a non-dispersive VI-improver according to the state of the art (Viscoplex® 4-550, supplied by the firm Röhm GmbH) was added, to adjust the measured viscosity.

The Volkswagen cam- and tappet wear test (PV 5106) was used to measure wear (for description see "Test Specification P-VW 5106"). The test results are presented in Table 2.

Results

Table 2 shows the results for the inventive formulation compared with those for the state of the art, in the measurement of cam- and tappet wear. The test results provide the maximum value as required in the VW approval secifications.

It may be seen from the Table that if one replaces polyisobutylene-bis-succinimide (PIB-bis-succinimide) in the amount of 1.5 wt. % by a polymer component PC in the form of the product of Example A-1, the content of ZnDDP additives can be reduced from 0.8 wt. % to 0.5 wt. % or less.

This corresponds to reduction of the phosphorus content of the formulation from 0.068% to 0.043%, and reduction of the zinc content from 0.078% to 0.049%. In contrast, if the 1.5 wt. % content of PIB-bis-succinimide is replaced by a dispersive, nitrogen-containing polymer additive known in the art (Viscoplex® 2–500, supplied by the firm Röhm), any reduction in the content of the ZnDDP additive is at cost of effectiveness.

TABLE 1

Volkswagen cam- and tappet wear test PV 5106. Customery commercial DI (detergent-inhibitor) components:

| Description | Sulfate ash (wt. %) | Component TBN (total base number) (mg KOH/g) | Formulation Dose (wt. %) Basic package | Core package |
|---|---|---|---|---|
| Weakly over-based Ca sulfonate* | 8.0 | 17 | 1.4 | 1.4 |
| Overbased Ca alkyl phenate* | 31.4 | 257 | 2.8 | 2.8 |
| PIB-bis-succin-imide* | — | 23 | 5.5 | 4.0 |
| Zinc dialkyl dithiophosphate (ZnDDP) | 27 | — | 1.1 | — |
| Total of doses: | | | 10.8 | 8.2 |
| TBN | | | 8.7 | 8.4 |

TABLE 1-continued

Volkswagen cam- and tappet wear test PV 5106. Customery commercial DI (detergent-inhibitor) components:

| Description | Sulfate ash (wt. %) | Component TBN (total base number) (mg KOH/g) | Formulation Dose (wt. %) Basic package | Core package |
|---|---|---|---|---|
| (mg KOH/g) Sulfated ash (wt. %) | | | 1.29 | 0.99 |

*The four components are all ordinary commercially available products.

TABLE 2

Volkswagen cam- and tappet wear test PV 5106: Numerical results. (Amount of "Core Package" used: 8.2 wt. %)

| Ordinary commercially used ZnDDP | 1.1 wt. % | 0.8 wt. % | 0.6 wt. % | 0.5 wt. % |
|---|---|---|---|---|
| 1.5 wt. % ordinary commercial PIB-bis-succinimide | 66/74 (7273) | 60/64 (7275) | test term.* (7304) | test term.* (7295) |
| 6.7 wt.% Viscoplex(R) 2-500 (comparison test) | — | — | test term.* (7329) | — |
| 6.8 wt. % additive from Example A-1 | — | 44/76 (7274) | 68/68 (7303) | 53/63 (7294) |
| Zn, wt. % | 0.108 | 0.078 | 0.059 | 0.049 |
| P, wt. % | 0.094 | 0.068 | 0.051 | 0.043 |
| Dispersive components: | Measured wear (microns) cam/tappet** (oil number) | | | |

Footnotes:
*Excessive wear before regular test end
**Permissible wear: max. 75 micron for cam, max. 100 micron for tappet.

Having now fully described the invention, it will be apparent to one of ordinary skill in the art that many changes and modifications can be made thereto without departing from the spirit or scope of the invention as set forth herein.

What is claimed as new and is desired to be secured by Letters Patent of the United States is:

1. A motor oil or transmission oil of a commercial SAE single- or multi-viscosity class, which contains polymeric additives and which has high dispersivity and good wear protection characteristics, said oil comprising the following additives:

(i) at least one heavy-duty antioxidant or wear protective agent comprising a phosphorus containing antioxidant and antiwear compound; and (ii) an oligomeric or polymeric compound, which functions as a dispersing agent, comprised of:

(a) units of alkyl(meth)acrylates of formula I

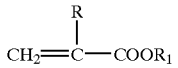

(I)

wherein R represents hydrogen or methyl, and $R_1$ represents an alkyl group with 4–34 C atoms, said tits of formula I being present in the amount of 60–99.5 parts by weigh, based on the total weight of monomers in the oligomeric or polymeric compound, and (b) units of at least one funtionalized alkyl(meth) acrylate of formula II

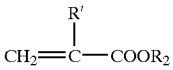

(II)

where $R^1$ represents hydrogen or methyl, and $R_2$ represents an alkyl group having 2–6 C atoms and substituted with at least one OH group, or $R_2$ represents an alkoxylated group of the formula

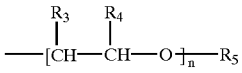

where $R_3$ and $R_4$ each represent hydrogen or methyl, $R_5$ represents an alkyl or alkyl group having 1–40 C atoms, and n is an integer ranging from 1–60 and if n≧2, then $R_5$, in addition, may be hydrogen, said units of formula II being present in the amount of 0.5–40 parts by weight, being present, based on the total weight of monomers I and II in the oligomeric or polymeric compound, (c) units of one or more monomers of formula III

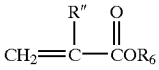

(III)

where R" represents hydrogen or methyl, and $R_6$ represents an alkyl group with 1–5 C atoms, said units of formula III being present in the amount of 0–20 parts by weight, based on the total weight of monomers I and II in the oligomeric or polymeric compound, and (d) units of 1-alkenes of formula IV $$CH_2{=}CHR_7 \quad \text{(IV)}$$

where $R_7$ represents an alkyl group having 2–40 C atoms, said units of formula IV being present in the amount of 0–50 parts by weight, based on the total weight of monomers I and II in the oligomeric or polymeric compounds; with the following provisions:

(1) the units of formulas I and II together comprise 100 wt. %, (2) the content of component (ii) in the motor or transmission oil ranges from 0.5–50 wt. %, and (3) wherein phosphorus content of the motor- or transmission oil is 0.043 to 0.68 wt. %.

2. The oil according to claim 1, wherein the oligomeric or polymeric component (ii) is used in combination with an olefin copolymer in the form of a concentrated polymer emulsion.

3. The oil according to claim 1, wherein said alkyl of group $R_1$ contains from 8–22 carbon atoms, said alkyl or alkaryl of group $R_5$ has 1 to 18 carbon atoms, said units of Formula III being present in an amount of 0.5 to 15 parts by wt and said alkyl of group $R_7$ containing from 4 to 24 carbon atoms.

4. The oil according to claim 1, wherein said monomers of formula (I) are selected from the group consisting of butyl acrylate, 2-ethylhexyl acrylate, cyclohexyl acrylate, isodecyl acrylate, tridecyl acrylate, tetradecyl acrylate, pentadecyl acrylate, dodecyl-pentadecyl acrylate, hexadecyl acrylate, heptadecyl acrylate, octadecyl acrylate, cetyl-stearyl acrylate, oleyl acrylate, nonadecyl acrylate, eicosyl acrylate, cetyl-eicosyl acrylate, stearyl-eicosyl acrylate, docosyl acrylate, eicosyl-tetratriacontyl acrylate; and the corresponding methacrylates.

5. The oil according to claim 1, wherein said olefins of formula (IV) are selected from the group consisting of 1-butene, 1-pentene, 1-hexene, 1-heptene, 1-octene, 1-nonene, 1-decene, 1-undecene, 1-dodecene, 1-tridecene, 1-tetradecene, pentadecene, 1-hexadecene, 1-heptadecene, 1-octadecene, 1-nonadecene,-1-eicosene, 1-heneicosene, 1-docosene, 1-tricosene, 1-tetracosene, 1-pentacosene, 1-hexacosene, 1-heptacosene, 1-octacosene, 1-nonacosene, 1-triacontene, 1-hentriacontene, 1-dotriacontene, vinylcyclohexene, 3,3-dimethyl-1-butene, 3-methyl-1-butene, and diisobutylene-4-methyl-1-pentene.

* * * * *